US011353807B2

(12) United States Patent
Park et al.

(10) Patent No.: US 11,353,807 B2
(45) Date of Patent: Jun. 7, 2022

(54) TONER CARTRIDGE MOVABLE TO DETACHMENT DIRECTION BY REVERSE ROTATION OF COUPLER

(71) Applicant: HEWLETT-PACKARD DEVELOPMENT COMPANY, L.P., Spring, TX (US)

(72) Inventors: Seungchan Park, Gyeonggi-do (KR); Youngchae Kim, Gyeonggi-do (KR); Junhui Kim, Gyeonggi-do (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/309,486

(22) PCT Filed: Mar. 10, 2020

(86) PCT No.: PCT/US2020/021859
§ 371 (c)(1),
(2) Date: Jun. 1, 2021

(87) PCT Pub. No.: WO2021/055005
PCT Pub. Date: Mar. 25, 2021

(65) Prior Publication Data

US 2022/0043369 A1 Feb. 10, 2022

(30) Foreign Application Priority Data

Sep. 20, 2019 (KR) ..... 10-2019-0116412

(51) Int. Cl.
*G03G 15/08* (2006.01)
*G03G 21/16* (2006.01)

(52) U.S. Cl.
CPC ..... *G03G 15/0872* (2013.01); *G03G 15/0891* (2013.01); *G03G 21/1647* (2013.01); *G03G 2221/1657* (2013.01)

(58) Field of Classification Search
CPC ..... G03G 15/0872; G03G 15/0891; G03G 15/0894; G03G 21/1647; G03G 21/1676;
(Continued)

(56) References Cited

U.S. PATENT DOCUMENTS 7,310,489 B2 12/2007 Kawai
9,684,261 B2 6/2017 Miyabe et al.
(Continued)

FOREIGN PATENT DOCUMENTS

JP H10319693 12/1998
JP 2002341636 11/2002
(Continued)

*Primary Examiner* — Sophia S Chen
(74) *Attorney, Agent, or Firm* — Trop Pruner & Hu, P.C.

(57) ABSTRACT

An example toner cartridge includes a housing to accommodate toner and having a toner discharge port at one side, a conveying member inside the housing to rotate to convey the toner toward the toner discharge port, a driven coupler to rotate by a rotational force, and an ejector to rotate by the driven coupler. Either one of the driven coupler and the ejector is rotatably supported by a side wall of the housing in the longitudinal direction and connected to the conveying member to rotate the conveying member. The other one of the driven coupler and the ejector moves in a direction spaced apart from the side wall with respect to either one of the driven coupler and the ejector when the driven coupler rotates in a reverse direction which is an opposite direction to a forward direction in which the toner is conveyed toward the toner discharge port.

15 Claims, 11 Drawing Sheets

(58) Field of Classification Search
CPC ..... G03G 21/186; G03G 2215/0802; G03G 2221/1657; G03G 2221/163
See application file for complete search history.

(56) References Cited

U.S. PATENT DOCUMENTS

| | | | | |
|---|---|---|---|---|
| 10,248,071 | B2 | 4/2019 | Takagi et al. | |
| 11,073,787 | B2 * | 7/2021 | Maeshima | G03G 21/186 |
| 2018/0188682 | A1 * | 7/2018 | Kim | G03G 21/1647 |
| 2019/0227477 | A1 * | 7/2019 | Hanamoto | G03G 21/1647 |

FOREIGN PATENT DOCUMENTS

| | | | |
|---|---|---|---|
| JP | 2002351203 | | 12/2002 |
| JP | 2005031109 | | 2/2005 |
| JP | 3809412 | B2 | 8/2006 |
| JP | 2016057467 | | 4/2016 |

* cited by examiner

TONER CARTRIDGE MOVABLE TO DETACHMENT DIRECTION BY REVERSE ROTATION OF COUPLER

BACKGROUND

An electrophotographic image forming apparatus may form a visible toner image on a photoconductor by supplying toner to an electrostatic latent image formed on the photoconductor, transfer the toner image through an intermediate transfer medium or directly to a printing medium, and fix the transferred toner image to the printing medium.

Toner, as a developer, is accommodated in a toner cartridge. The toner cartridge is a consumable that may be replaced, such as when the toner accommodated therein is exhausted. The toner cartridge includes a conveying member that conveys the toner accommodated therein to a toner discharge port. The conveying member is driven by receiving power from a main body of an image forming apparatus when the toner cartridge is mounted on the main body.

BRIEF DESCRIPTION OF THE DRAWINGS

Various examples will be described below by referring to the following figures.

DETAILED DESCRIPTION OF EXAMPLES

Figure 1:
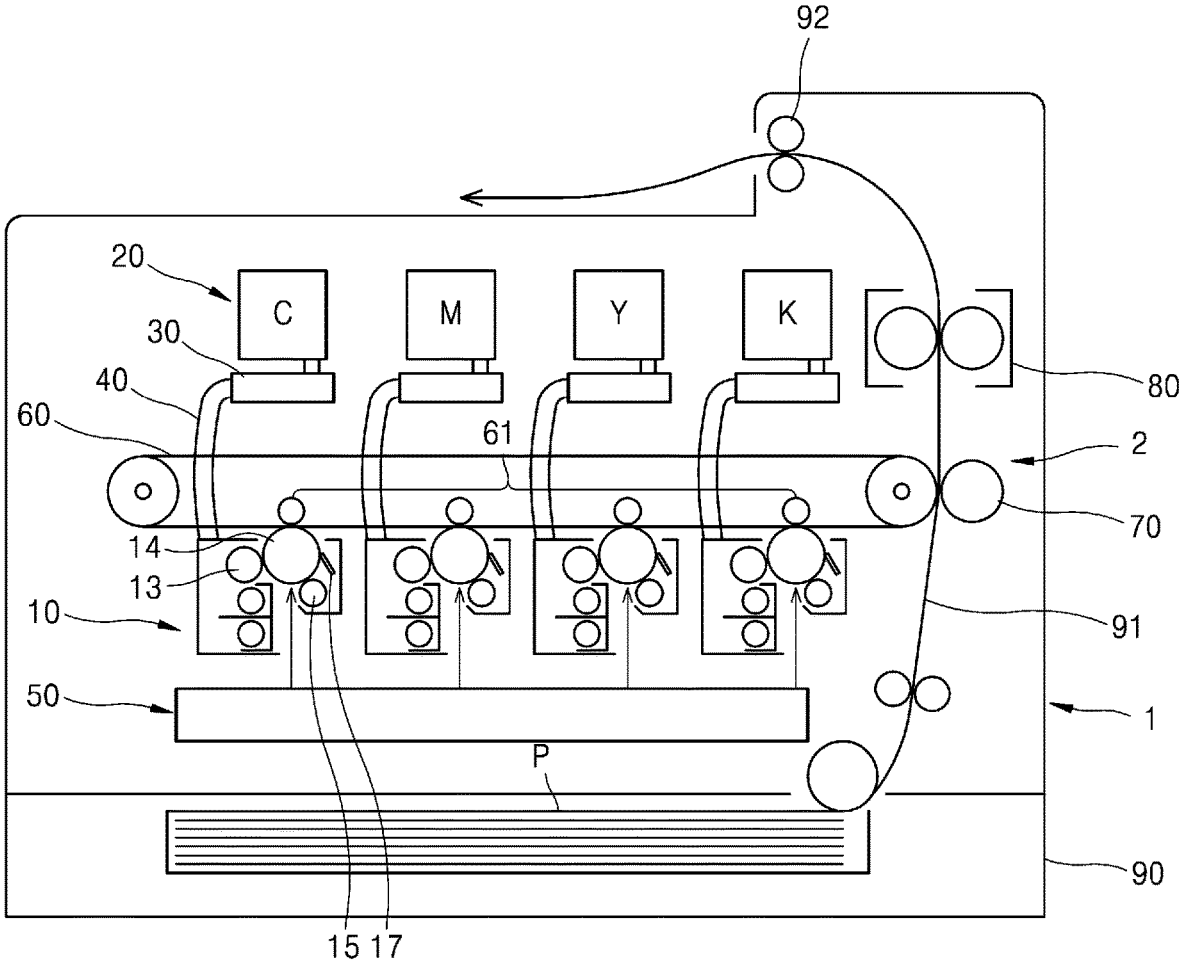
FIG. 1 is a schematic configuration diagram of an electrophotographic image forming apparatus according to an example.

Hereinafter, various examples will be described with reference to the drawings. Like reference numerals in the specification and the drawings denote like elements, and thus a redundant description may be omitted.

Figure 2:
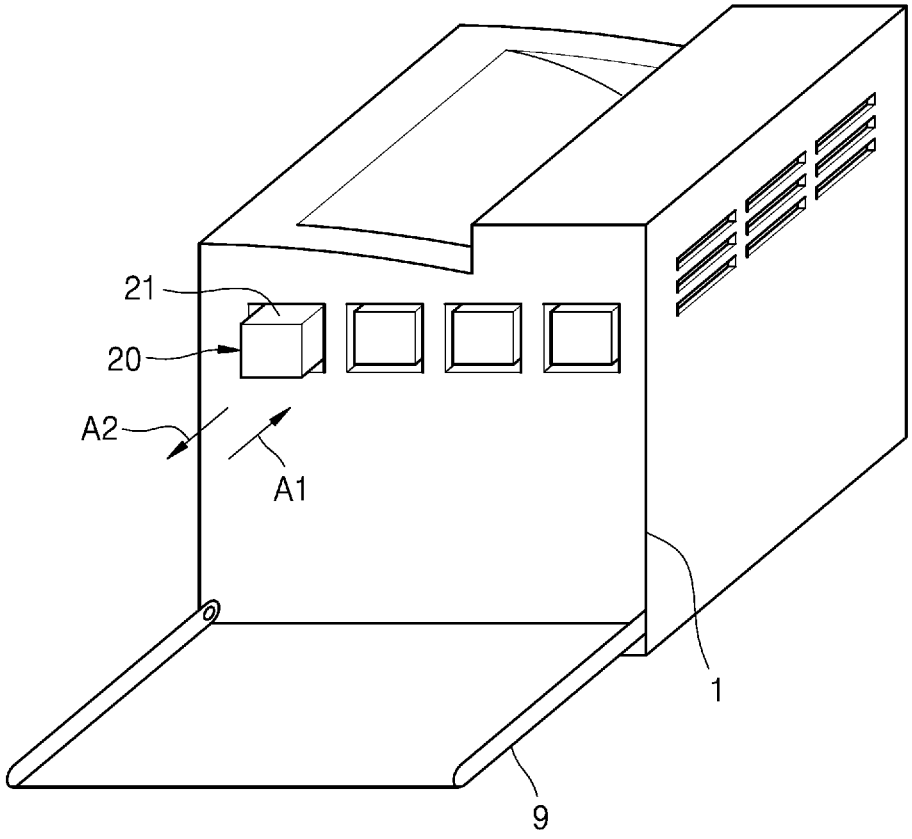
FIG. 2 is a schematic perspective view illustrating a state of replacing a toner cartridge according to an example.

FIG. 1 is a schematic configuration diagram of an electrophotographic image forming apparatus according to an example. FIG. 2 is a schematic perspective view illustrating a state of replacing a toner cartridge according to an example.

Referring to FIGS. 1 and 2, an electrophotographic image forming apparatus includes a main body 1 and a toner cartridge 20 that is attachable to/detachable from the main body 1. The main body 1 includes a printing portion 2 that prints an image on a printing medium P by using an electrophotographic method. The toner cartridge 20 accommodates toner to be supplied to the printing portion 2. The printing portion 2 receives the toner from the toner cartridge 20 and prints the image on the printing medium P by using the electrophotographic method. The toner cartridge 20 is attachable to/detachable from the main body 1 by opening a door 9 and may be replaced individually. When the toner accommodated in the toner cartridge 20 is exhausted, the toner cartridge 20 may be replaced with a new toner cartridge 20. According to a developing method, toner and a carrier may be accommodated in the toner cartridge 20. The toner cartridge 20 may also be referred to as a "developer cartridge".

In the illustrated example, the printing portion 2 prints a color image on the printing medium P. The printing portion 2 may include a plurality of developing devices 10, an exposure device 50, a transfer unit, and a fuser 80. The image forming apparatus may include a plurality of toner cartridges 20. The plurality of toner cartridges 20 are respectively connected to the plurality of developing devices 10, and toner accommodated in the plurality of toner cartridges 20 is supplied to the plurality of developing devices 10, respectively. A toner supply unit 30 may be interposed between the toner cartridge 20 and the developing device 10. The toner supply unit 30 may receive toner from the toner cartridge 20 and supply the toner to the developing device 10 through a supply duct 40. Although not shown, the toner supply unit 30 may be omitted, and the supply duct 40 may directly connect the toner cartridge 20 and the developing device 10.

The plurality of developing devices 10 may include a plurality of developing devices 10C, 10M, 10Y, and 10K for respectively forming toner images of cyan C, magenta M, yellow Y, and black K colors. In addition, the plurality of toner cartridges 20 may include a plurality of toner cartridges 20C, 20M, 20Y, and 20K respectively accommodating toners of the cyan C, magenta M, yellow Y, and black K colors that are to be supplied to the plurality of developing devices 10C, 10M, 10Y, and 10K. Hereinafter, a printer including the plurality of developing devices 10C, 10M, 10Y, and 10K and the plurality of toner cartridges 20C, 20M, 20Y, and 20K will be described. Unless otherwise noted, reference numerals including C, M, Y, and K refer to components for developing the toners of the cyan C, magenta M, yellow Y, and black K colors, respectively.

The developing device 10 may include a photoconductive drum 14 having a surface on which a latent electrostatic image may be formed and a developing roller 13 to supply toner to the electrostatic latent image to develop a visible toner image. A charging roller 15 may be an example of a charger that charges the photoconductive drum 14 to have a uniform surface electric potential. Instead of the charging roller 15, a charging brush, a corona charger, etc. may be employed. The developing device 10 may further include a charging roller cleaner (not shown) to remove foreign substances such as toner and dust adhered to the charging roller 15, a cleaning member 17 to remove toner remaining on a surface of the photoconductive drum 14 after an intermediate transferring process that will be described later, a regulating member (not shown) to regulate an amount of toner supplied to a developing region where the photoconductive drum 14 and the developing roller 13 oppose each other, etc. The cleaning member 17 may be, for example, a cleaning blade that contacts the surface of the photoconductive drum 14 to scrape the toner.

The exposure device 50 irradiates light modulated in correspondence with image information onto the photoconductive drum 14 to form the electrostatic latent image on the photoconductive drum 14. Examples of the exposure device 50 include a laser scanning unit (LSU) using a laser diode as a light source, a light emitting diode (LED) exposure device using an LED as the light source, etc.

Toner may be supplied to the photoconductive drum 14 by a developing bias voltage applied between the developing roller 13 and the photoconductive drum 14 such that the electrostatic latent image formed on the surface of the photoconductive drum 14 may be developed into a visible toner image.

The transfer unit transfers the toner image formed on the photoconductive drum 14 onto the printing medium P. In an example, an intermediate transfer-type transfer unit is employed. As an example, the transfer unit may include an intermediate transfer belt 60, an intermediate transfer roller 61, and a transfer roller 70. A plurality of intermediate transfer rollers 61 may be disposed at positions respectively opposing the photoconductive drums 14 of the plurality of developing devices 10C, 10M, 10Y, and 10K with the intermediate transfer belt 60 therebetween. An intermediate transfer bias voltage for intermediately transferring the toner image developed on the photoconductive drum 14 to the intermediate transfer belt 60 may be applied to the plurality of intermediate transfer rollers 61. Instead of the intermediate transfer roller 61, a corona transfer unit or a pin scorotron transfer unit may be employed.

The transfer roller 70 may be positioned to oppose the intermediate transfer belt 60. A transfer bias voltage for transferring the toner image intermediately transferred to the intermediate transfer belt 60 to the print medium P may be applied to the transfer roller 70.

The fuser 80 applies heat and/or pressure to the toner image transferred to the printing medium P to fix the toner image on the printing medium P. A shape of the fuser 80 is not limited to the example shown in FIG. 1.

According to the example described above, the exposure device 50 scans light that is modulated corresponding to image information of each color to the photoconductive drum 14 of the plurality of developing devices 10C, 10M, 10Y, and 10K to form the electrostatic latent image on the photoconductive drum 14. The electrostatic latent image of the photoconductive drum 14 of the plurality of developing devices 10C, 10M, 10Y, and 10K may be developed into the visible toner image by the C, M, Y, and K toner supplied from the plurality of toner cartridges 20C, 20M, 20Y, and 20K to the plurality of developing devices 10C, 10M, 10Y, and 10K. The developed toner images may be intermediately transferred to the intermediate transfer belt 60 sequentially. The printing medium P loaded on a paper feeding tray 90 may be transported along a paper feeding path 91 and transported between the transfer roller 70 and the intermediate transfer belt 60. The toner image intermediately transferred onto the intermediate transfer belt 60 may be transferred to the printing medium P by the transfer bias voltage applied to the transfer roller 70. When the printing medium P passes the fuser 80, the toner image is fixed to the printing medium P by heat and pressure. The printing medium P on which fixing is completed may be discharged by a discharge roller 92.

As shown in FIG. 2, the toner cartridge 20 may be attached/detached to/from the main body 1. As an example, the toner cartridge 20 may be slid in an axial direction of the developing roller 13 to be attached/detached to/from the main body 1.

Figure 3:
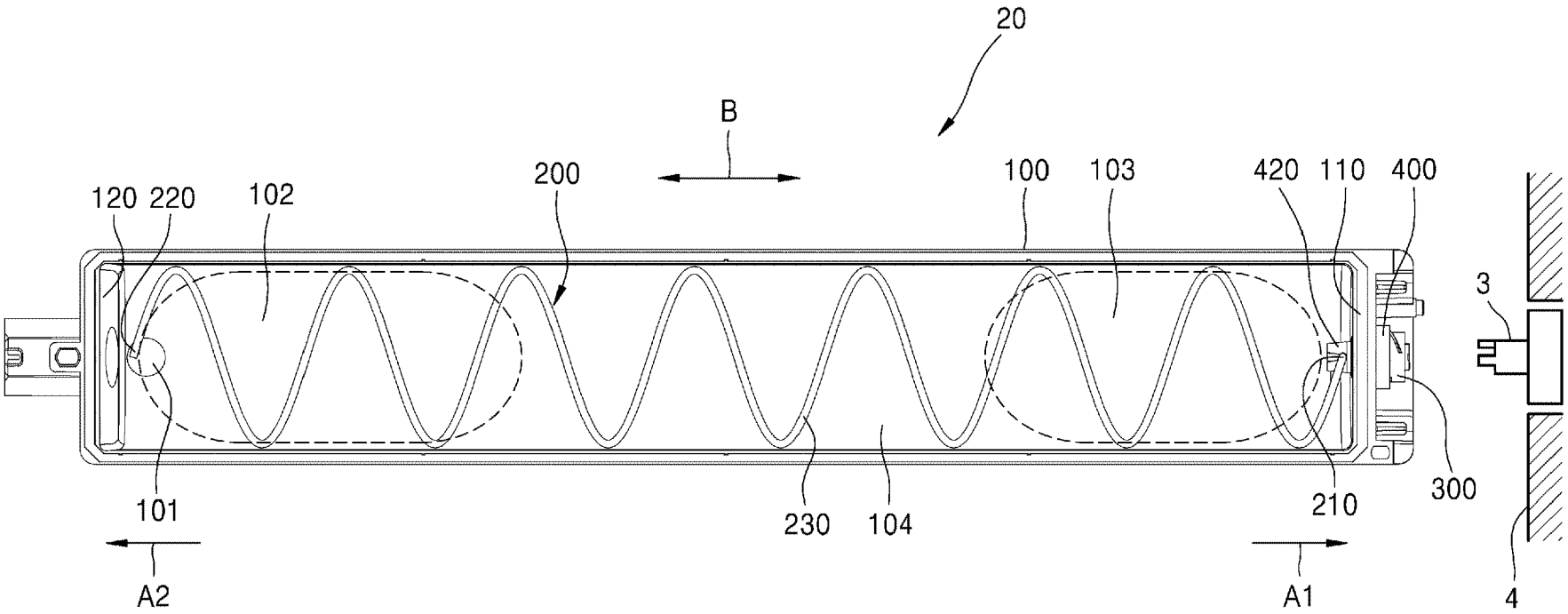
FIG. 3 is a schematic plan view illustrating an interior of a toner cartridge according to an example.

FIG. 3 is a schematic plan view illustrating an interior of a toner cartridge according to an example.

Referring to FIG. 3, the toner cartridge 20 may include a housing 100, a conveying member 200, a driven coupler 300, and an ejector 400.

A toner may be accommodated in the housing 100. A toner discharge port 101, through which the toner may be discharged, is provided at one side of the housing 100 in a longitudinal direction B. The longitudinal direction B may be an attachable/detachable direction of the toner cartridge 20. The housing 100 includes side walls 110 and 120 spaced apart in the longitudinal direction B. The side wall 110 may be a side wall in a mounting direction A1, and the side wall 120 may be a side wall in a removal direction A2. The toner discharge port 101 may be provided at a position adjacent to either of the side walls 110 and 120. In the illustrated example, the toner discharge port 101 is located adjacent to a downstream end with respect to a toner conveying direction of the conveying member 200 among the side walls 110 and 120. In the illustrated example, the toner discharge port 101 is located adjacent to the side wall 120. The toner cartridge 20 may be provided with a shutter (not shown) to selectively open and close the toner discharge port 101.

The conveying member 200 is located inside the housing 100 and rotates to convey toner toward the toner discharge port 101. The conveying member 200 may convey toner in the longitudinal direction B. In an example, the conveying member 200 may be in the form of a spiral coil extending in the longitudinal direction B. The conveying member 200 may include a spiral portion 230 extending in a spiral shape between one end portion 210 and the other end portion 220. This type of conveying member 200 may be referred to as a spring auger.

The driven coupler 300 rotates by receiving a rotational force from an external source. As an example, the main body 1 may be provided with a driving coupler 3. The driving coupler 3 rotates by a driving motor that is not shown. When the toner cartridge 20 is mounted on the main body 1, the driven coupler 300 is connected to the driving coupler 3 provided on the main body 1. The driven coupler 300 provides a rotational force to the conveying member 200.

When it is necessary to replace the toner cartridge 20, a user may remove the toner cartridge 20 from the main body 1 by holding the side wall 120 of the toner cartridge 20 and pulling the side wall 120 in the removal direction A2. In that case, the side wall 120 of the toner cartridge 20 may be provided with a structure that the user may hold. However, such a holding structure may cause a decrease in the toner storage capacity of the toner cartridge 20.

When the toner cartridge 20 is attached/detached, contamination of the toner cartridge 20 and/or the main body 1 may occur due to scattering of toner in an attachment/detachment process. In addition, when the toner cartridge 20 normally operates in a state where the toner cartridge 20 is mounted on the main body 1, the toner is mainly present in a peripheral region 102 of the toner discharge port 101. When the toner cartridge 20 is removed and remounted during use, the toner may be collected in a region 103 that is away from the toner discharge port 101. In that case, the supply of toner may become unstable at the initial stage of remounting the toner cartridge 20, which may adversely affect image quality, and a toner remaining amount detection error of the toner cartridge 20 may occur.

The toner cartridge 20 may have a structure in which the toner cartridge 20 slides in the removal direction A2 by rotation of the driven coupler 300 when it is necessary to remove the toner cartridge 20. As shown in FIG. 2, when the toner cartridge 20 slightly slides in the removal direction A2, a portion 21 of the toner cartridge 20 slightly protrudes from the main body 1, and the user may remove the toner cartridge 20 from the main body 1 by holding the protruding portion 21. Therefore, it is not necessary to provide a holding structure in the toner cartridge 20 so that a reduction of the toner storage capacity of the toner cartridge 20 may be avoided, and the removal of the toner cartridge 20 and a problem caused by this may be addressed.

Hereinafter, an example of a structure in which the toner cartridge 20 slides in the removal direction A2 by the rotation of the driven coupler 300 will be described.

The toner cartridge 20 includes the ejector 400. The ejector 400 rotates by the driven coupler 300. Either one of the driven coupler 300 and the ejector 400 is rotatably supported by the side wall 110 of the housing 100 in the longitudinal direction B and connected to the conveying member 200 to rotate the conveying member 200. The other one of the driven coupler 300 and the ejector 400 moves in a direction spaced apart from the side wall 110 with respect to either one of the driven coupler 300 and the ejector 400 when the driven coupler 300 rotates in a reverse direction (e.g., RB in FIG. 4) opposite a forward direction (e.g., RF in FIG. 4) in which the driven coupler 300 conveys toner toward the toner discharge port 101. For convenience, a member (e.g., either one of the driven coupler 300 and the ejector 400) supported by the side wall 110 is referred to as a first member, and a member not supported by the side wall 110 is referred to as a second member. When the driven coupler 300 rotates in the forward direction RF by the driving coupler 3, the first member rotates in the forward direction RF. When the driven coupler 300 rotates in the reverse direction RB by the driving coupler 3, the second member is to move away from the side wall 110, that is, in the mounting direction A1, but the second member may not move in the mounting direction A1 because it is blocked by the driving coupler 3 or a blocking wall 4 provided in the main body 1. In that case, the first member relatively moves in the removal direction A2 with respect to the second member. The first member is supported by the side wall 110. Thus, the toner cartridge 20 except for the second member moves together with the first member in the removal direction A2. By such a configuration, the portion 21 of the toner cartridge 20 may be slightly projected from the main body 1.

Figure 4:
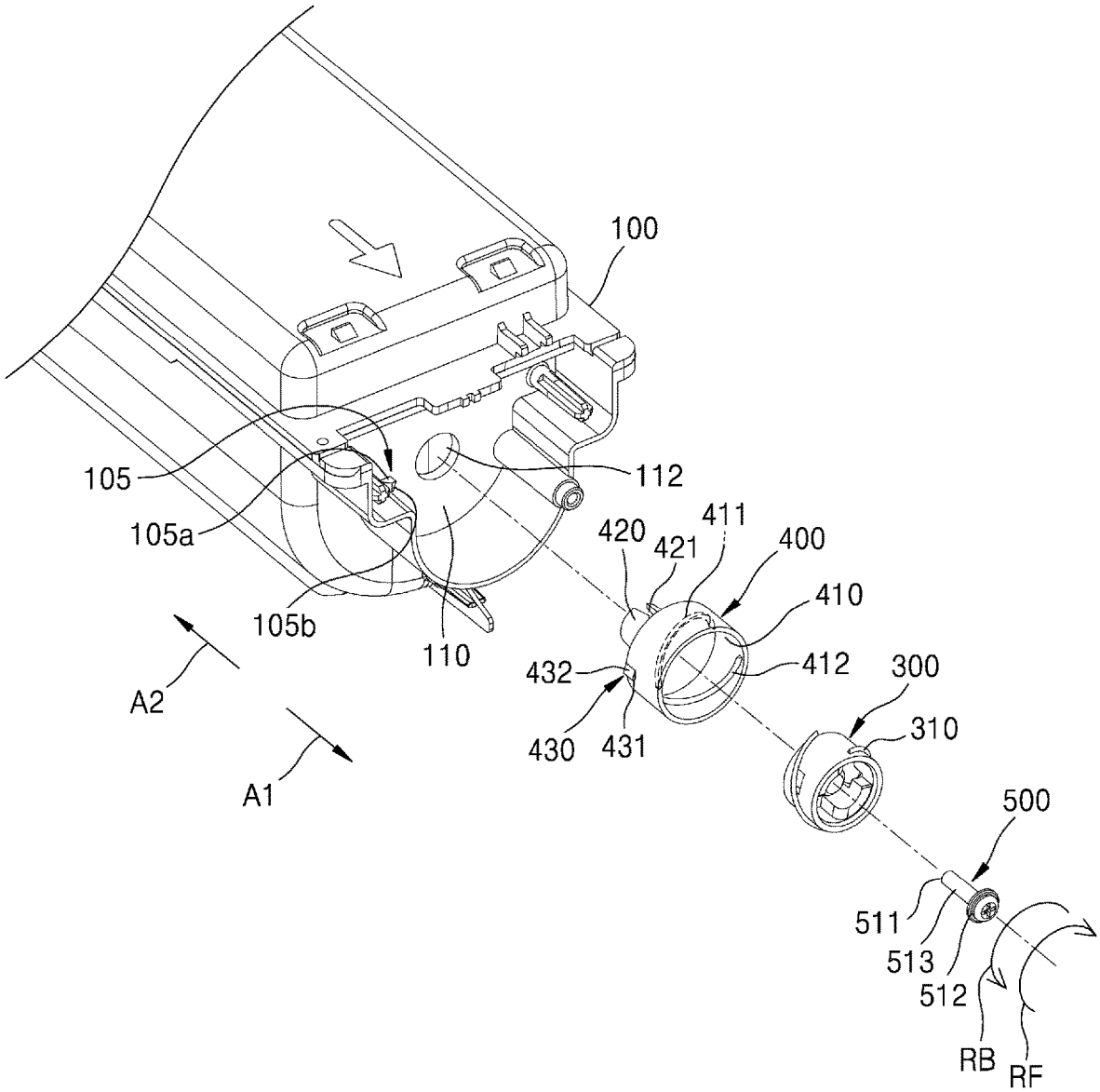
FIG. 4 is a partially exploded perspective view of the toner cartridge shown in FIG. 3 according to an example.
Figure 5:
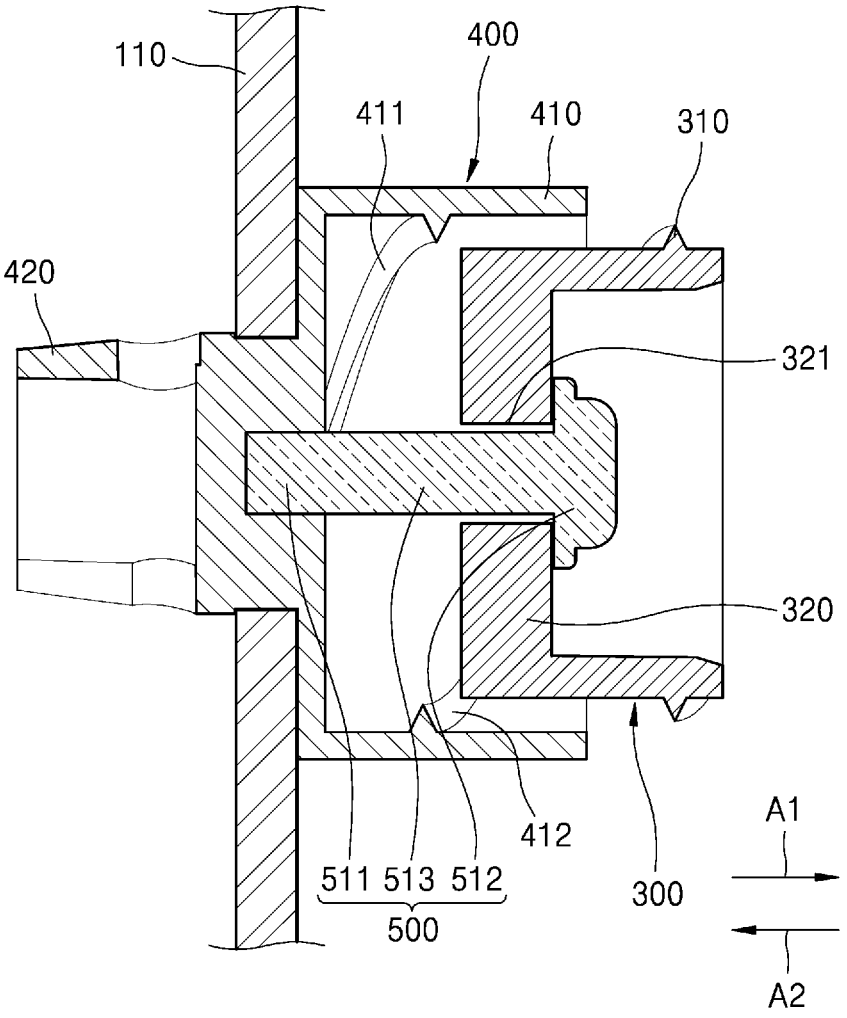
FIG. 5 is a cross-sectional view illustrating a connection relationship between a driven coupler and an ejector in the toner cartridge shown in FIG. 3 according to an example.
Figure 6:
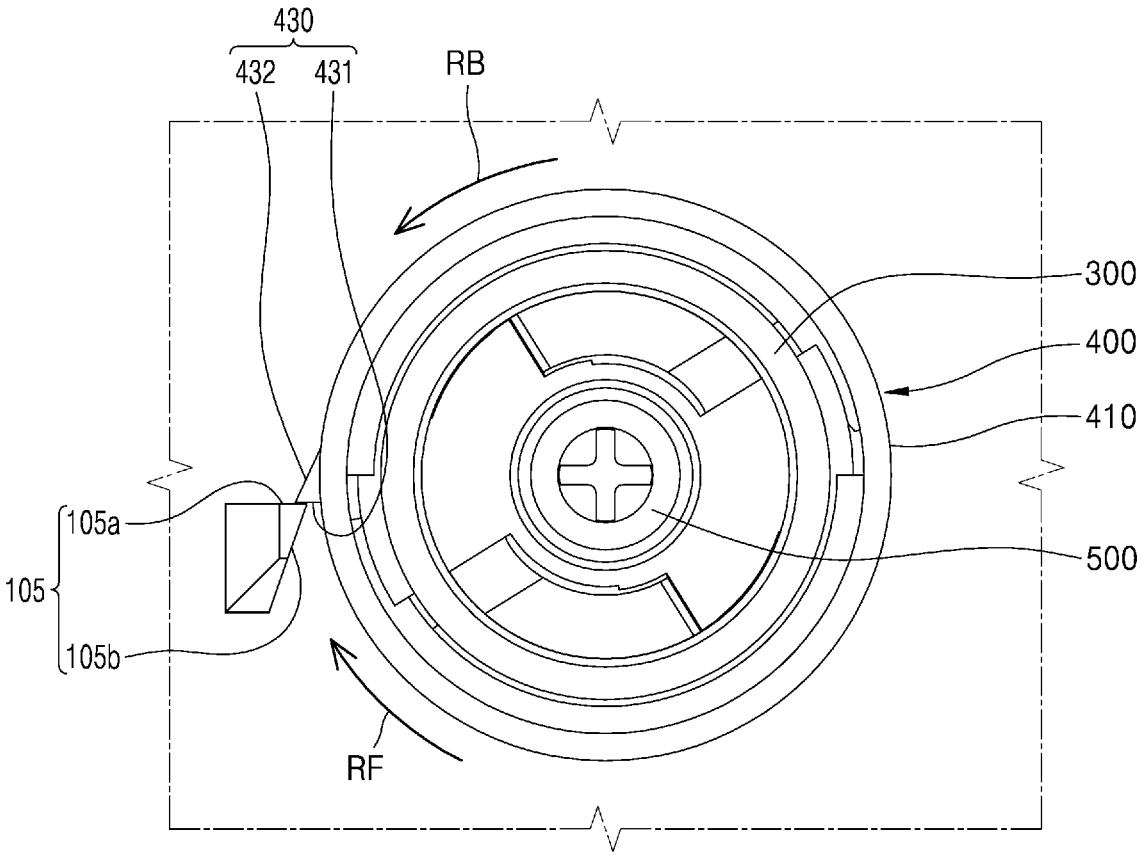
FIG. 6 is a diagram illustrating a rotation limiting member according to an example.
Figure 7:
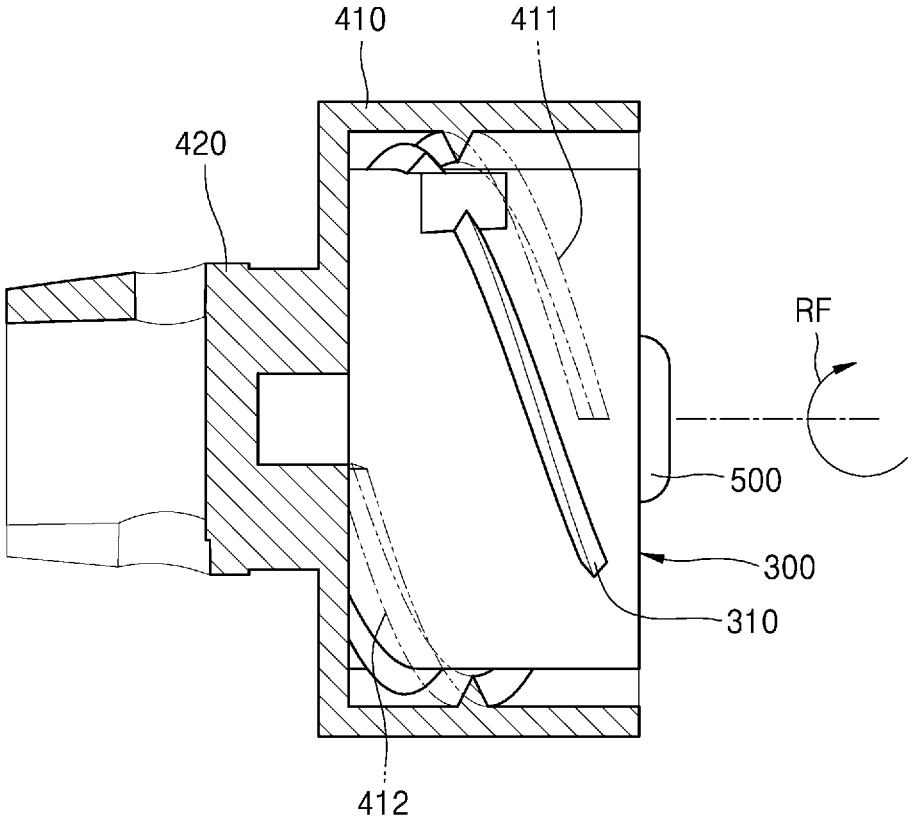
FIG. 7 illustrates a connection relationship between a driven coupler and an ejector when the driven coupler rotates in a forward direction in the toner cartridge shown in FIG. 3 according to an example.
Figure 8:
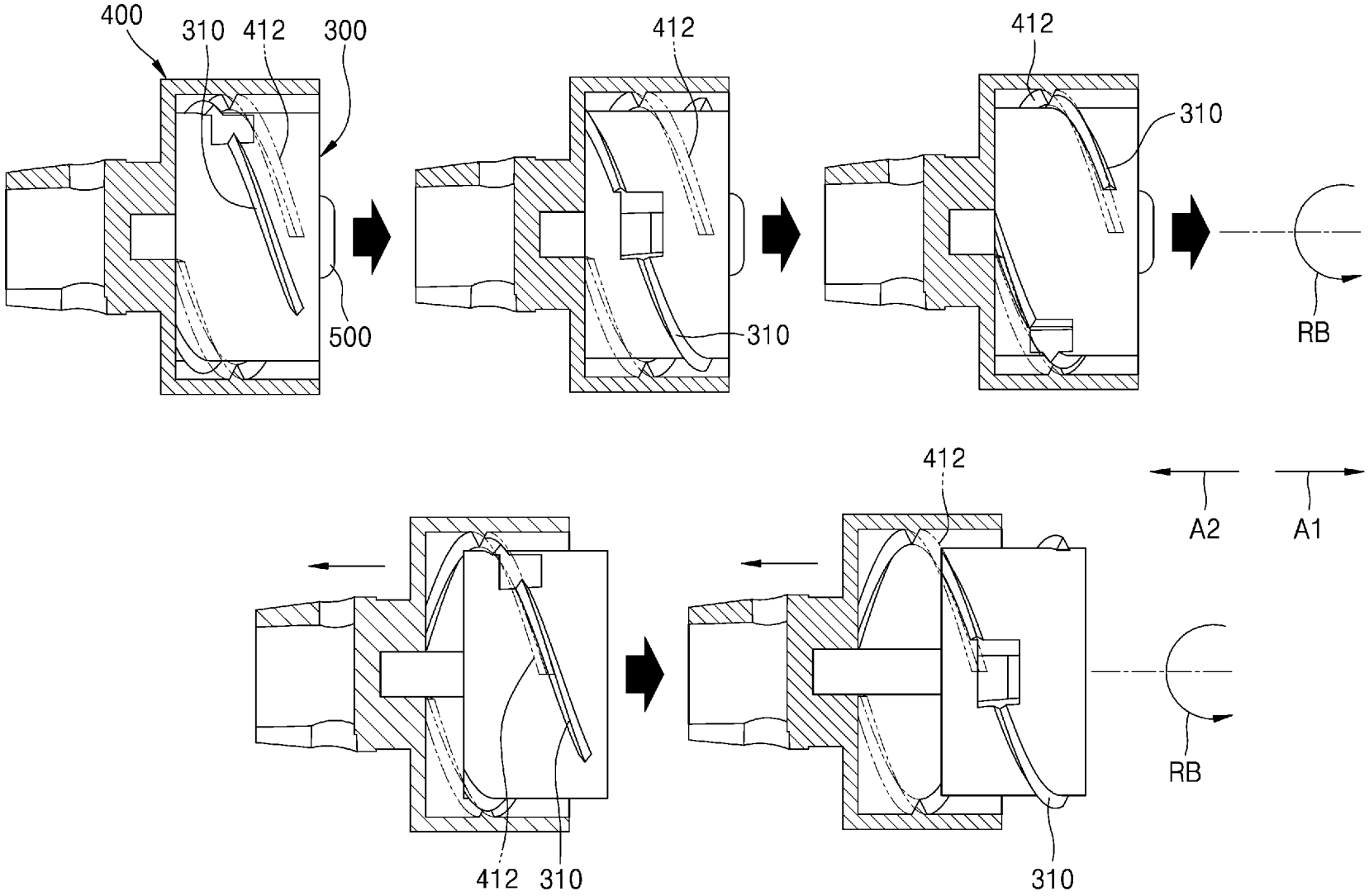
FIG. 8 illustrates a connection relationship between a driven coupler and an ejector when the driven coupler rotates in a reverse direction in the toner cartridge shown in FIG. 3 according to an example.

FIG. 4 is a partially exploded perspective view of the toner cartridge shown in FIG. 3 according to an example. FIG. 5 is a cross-sectional view illustrating a connection relationship between a driven coupler and an ejector in the toner cartridge shown in FIG. 3 according to an example. FIG. 6 is a diagram illustrating a rotation limiting member according to an example. FIG. 7 illustrates a connection relationship between a driven coupler and an ejector when the driven coupler rotates in a forward direction in the toner cartridge shown in FIG. 3 according to an example. FIG. 8 illustrates a connection relationship between a driven coupler and an ejector when the driven coupler rotates in a reverse direction in the toner cartridge shown in FIG. 3 according to an example.

Referring to FIGS. 3 and 4, in the toner cartridge 20, the ejector 400 is supported to be rotatable by the side wall 110 of the housing 100 and is connected to the conveying member 200 to rotate the conveying member 200. When the driven coupler 300 rotates in the reverse direction RB, the driven coupler 300 moves in a direction to be spaced apart from the side wall 110 with respect to the ejector 400, that is, the mounting direction A1. Because the driven coupler 300 is blocked by the drive coupler 3 in a state where the toner cartridge 20 is mounted on the main body 1, the driven coupler 300 may not move in the mounting direction A1. Therefore, the ejector 400 and the housing 100 move in the removal direction A2 with respect to the driven coupler 300.

The ejector 400 includes an inner diameter portion 410 and a connection portion 420. The connection portion 420 extends from the inner diameter portion 410 and may be inserted into the housing 100 through a mounting hole 112 provided in the side wall 110. As a result, the ejector 400 is supported to be rotatable by the side wall 110. The connection portion 420 may be coupled to the inner diameter portion 410 and may be integrally formed with the inner diameter portion 410.

The conveying member 200 may be connected to the connection portion 420. The one end portion 210 of the conveying member 200 extends in a radial direction. The connection portion 420 is provided with a slit 421 cut in the radial direction. The one end portion 210 of the conveying member 200 may be inserted into the slit 421. When the ejector 400 rotates, the slit 421 pushes the one end portion 210 in the radial direction to rotate the conveying member 200. When the conveying member 200 rotates, the spiral portion 230 of the conveying member 200 contacts a bottom 104 of the housing 100 and pushes toner inside the housing 100 in the longitudinal direction B to convey the toner toward the toner discharge port 101.

Referring to FIGS. 4 and 5, the driven coupler 300 may be inserted into the inner diameter portion 410 of the ejector 400. The outer circumference of the driven coupler 300 is opposed to the inner diameter portion 410. A gap exists between the outer circumference of the driven coupler 300 and the inner diameter portion 410, and the ejector 400 may move in the radial direction with respect to the driven coupler 300. The driven coupler 300 is rotatably supported by the ejector 400. In addition, the driven coupler 300 is supported by the ejector 400 to move in the mounting direction A1 and the removal direction A2. An amount of movement in a direction spaced apart from the side wall 110 of the driven coupler 300, that is, the mounting direction A1, may be limited by a regulating member 500.

The driven coupler 300 may include a regulating plate 320 and a through hole 321 provided in the regulating plate 320. The regulating member 500 may include a fixing portion 511 fixed to the ejector 400, an extension portion 513 extending in the longitudinal direction B from the fixing portion 511 and inserted into the through hole 321, and a regulating portion 512 provided at an end opposite to the fixing portion 511 of the extension portion 513 and engaged with the regulating plate 320. The extension portion 513 may be cylindrical. A diameter of the regulating portion 512 may be larger than the diameter of the extension portion 513. For example, the fixing portion 511 may be screw-shaped to be screwed to the ejector 400. The regulating portion 512 may have a screw head shape. Accordingly, the regulating member 500 may be a special screw including the cylindrical extension portion 513 between the screw-shaped fixing portion 511 and the screw head-shaped regulating portion 512. By such a configuration, the regulating plate 320 may engage with the regulating portion 512 so that the amount of movement in the direction spaced apart from the side wall 110 of the driven coupler 300 may be limited, and the driven coupler 300 is not separated from the ejector 400.

The ejector 400 rotates by the driven coupler 300. In the example of FIGS. 4 and 5, a driving transmission portion 310 is provided on the outer circumference of the driven coupler 300. A first driving receiving portion 411 is provided at the inner diameter portion 410 of the ejector 400. The first driving receiving portion 411 may engage with the driving transmission portion 310 such that the ejector 400 may rotate in the forward direction RF when the driven coupler 300 rotates in the forward direction RF. In an example, the driving transmission portion 310 may have a spiral shape protruding from the outer circumference of the driven coupler 300. The driving transmission portion 310 may have a spiral shape wound in the forward direction RF on the outer circumference of the driven coupler 300. The first driving receiving portion 411 may have a spiral shape wound in the forward direction RF such that the first driving receiving portion 411 may be engaged with the driving transmission portion 310 when the driven coupler 300 rotates in the forward direction RF. For example, an extension angle of the first driving receiving portion 411 may be about 180 degrees or less. As shown in FIG. 7, the driving transmission portion 310 is located on the side wall 110, that is, the removal direction A2, with respect to the first driving receiving portion 411. By such a configuration, when the driven coupler 300 rotates in the forward direction RF, the driving transmission portion 310 and the first driving receiving portion 411 are engaged with each other, and a force in a direction in which the driven coupler 300 and the ejector 400 are away from each other is applied therebetween. Because the ejector 400 is supported by the side wall 110, the ejector 400 may not move in a direction away from the driven coupler 300. Because the driving transmission portion 310 is engaged with the first driving receiving portion 411 in the removal direction A2, the driven coupler 300 may not be away from the ejector 400. Accordingly, the driven coupler 300 and the ejector 400 rotate together in the forward direction RF.

The toner cartridge 20 includes a rotation limiting member that allows rotation of the ejector 400 in the forward direction RF and does not allow rotation of the ejector 400 in the reverse direction RB. The rotation limiting member may be implemented by, for example, a one-way bearing (not shown) installed in the mounting hole 112 provided in the side wall 110 to rotatably support the ejector 400. As another example, referring to FIGS. 4 and 6, the rotation limiting member may include a first stopper 430 provided in the ejector 400 and a second stopper 105 provided in the housing 100 to have the first stopper 430 caught when the ejector 400 rotates in the reverse direction RB. For example, the first stopper 430 may protrude outward from an outer circumference of the inner diameter portion 410. The first stopper 430 may have a shape having an amount of protrusion gradually decreasing toward the forward direction RF. As a result, a first opposing surface 431 in the radial direction and a first inclination surface 432 inclined in the forward direction RF with respect to the first opposing surface 431 may be defined. The second stopper 105 may have a shape symmetrical with the first stopper 430. The second stopper 105 may include a second opposing surface 105*a* and a second inclination surface 105*b*.

By such a configuration, when the ejector 400 rotates in the forward direction RF, the first inclination surface 432 and the second inclination surface 105*b* contact each other. The first inclination surface 432 is pushed by the second inclination surface 105*b*. The first inclination surface 432 is spaced apart from the second inclination surface 105*b* when the ejector 400 is slightly pushed in the radial direction. The ejector 400 may continue to rotate in the forward direction RF. When the ejector 400 rotates in the reverse direction RB, the first opposing surface 431 and the second opposing surface 105*a* are in contact with each other, as shown in FIG. 6. The first opposing surface 431 and the second opposing surface 105*a* extend in the radial direction and are positioned to face each other. Thus, the ejector 400 may no longer rotate in the reverse direction RB.

When the driven coupler 300 rotates in the reverse direction RB, the driven coupler 300 moves in the direction away from the side wall 110. Referring to FIGS. 4 and 5, a second driving receiving portion 412 is provided in the inner diameter portion 410 of the ejector 400. The second driving receiving portion 412 may engage with the driving transmission portion 310 such that the driven coupler 300 moves in the direction spaced apart from the side wall 110 when the driven coupler 300 rotates in the reverse direction RB. As an example, the second driving receiving portion 412 may have a spiral shape wound in the forward direction RF having a rotational phase difference from the first driving receiving portion 411. For example, the phase difference of the second driving receiving portion 412 with respect to the first driving receiving portion 411 may be about 180 degrees. The winding angle of the second driving receiving portion 412 may be about 180 degrees or less. The second driving receiving portion 412 may be spaced apart from an opposite side of the side wall 110, that is, the mounting direction A1, with respect to the first driving receiving portion 411. When the driven coupler 300 rotates in the reverse direction RB, the driving transmission portion 310 is positioned in the mounting direction A1 of the second driving receiving portion 412.

When the driven coupler 300 rotates in the reverse direction RB, the ejector 400 may also rotate in the reverse direction RB. When the first opposing surface 431 is in contact with the second opposing surface 105*a*, the rotation of the ejector 400 stops and only the driven coupler 300 rotates in the reverse direction RB. When only the driven coupler 300 rotates in the reverse direction RB as shown in FIG. 8, the driving transmission portion 310 gradually moves toward the mounting direction A1 of the second driving receiving portion 412, and may engage with the second driving receiving portion 412. Because rotation of the ejector 400 in the reverse direction RB is not allowed, a force in a direction in which the driving transmission portion 310 and the second driving receiving portion 412 are away from each other is applied therebetween. Because the ejector 400 is supported by the side wall 110, the ejector 400 may not move toward the side wall 110. Therefore, the driven coupler 300 needs to move away from the side wall 110, i.e. in the mounting direction A1. Because the driven coupler 300 is in engagement with the driving coupler 3, the driven coupler 300 may not move in the mounting direction A1. Therefore, the ejector 400 moves together with the housing 100 in the removal direction A2.

An example process of mounting and removing the toner cartridge 20 to the main body 1 will be described. The toner cartridge 20 is mounted in the main body 1 by sliding the toner cartridge 20 in the mounting direction A1. In that case, the driven coupler 300 is connected to the drive coupler 3. When the driven coupler 300 rotates in the forward direction RF by the driving coupler 3, the driving transmission portion 310 is engaged with the first driving receiving portion 411, and the ejector 400 rotates in the forward direction RF. The conveying member 200 rotates inside the housing 100 to convey toner toward the toner discharge port 101.

When it is detected that the remaining amount of toner in the toner cartridge 20 is in a toner empty state, an image forming apparatus may generate a toner empty signal through a user interface that is not shown. For example, the toner empty signal may be visually displayed through a display of the image forming apparatus, or may be displayed as an audio signal. The toner empty signal may also be displayed on a display of a host connected to the image forming apparatus.

The user may transmit a replacement command of the toner cartridge 20 to the image forming apparatus through the input means of the image forming apparatus or through the host. In that case, the image forming apparatus may drive a driving motor to rotate the driven coupler 300 in the reverse direction RB. When the first opposing surface 431 is in contact with the second opposing surface 105*a*, the rotation of the ejector 400 stops and only the driven coupler 300 rotates in the reverse direction RB. The driving transmission portion 310 and the second driving receiving portion 412 are engaged with each other. Because the ejector 400 does not rotate, a force in the direction away from the side wall 110, that is, the mounting direction A1, is applied to the driven coupler 300. Because the driven coupler 300 is in engagement with the driving coupler 3, the driven coupler 300 may not move in the mounting direction A1. Therefore, the ejector 400 moves together with the housing 100 in the removal direction A2, and when rotation of the driving motor stops, the toner cartridge 20 stops at a position where the portion 21 in the removal direction A2 partially protrudes from the main body 1 as shown in FIG. 2. The user may hold the protruding portion 21 in the removal direction A2 and remove the toner cartridge 20 from the main body 1 by pulling the toner cartridge 20 in the removal direction A2.

Figure 9:
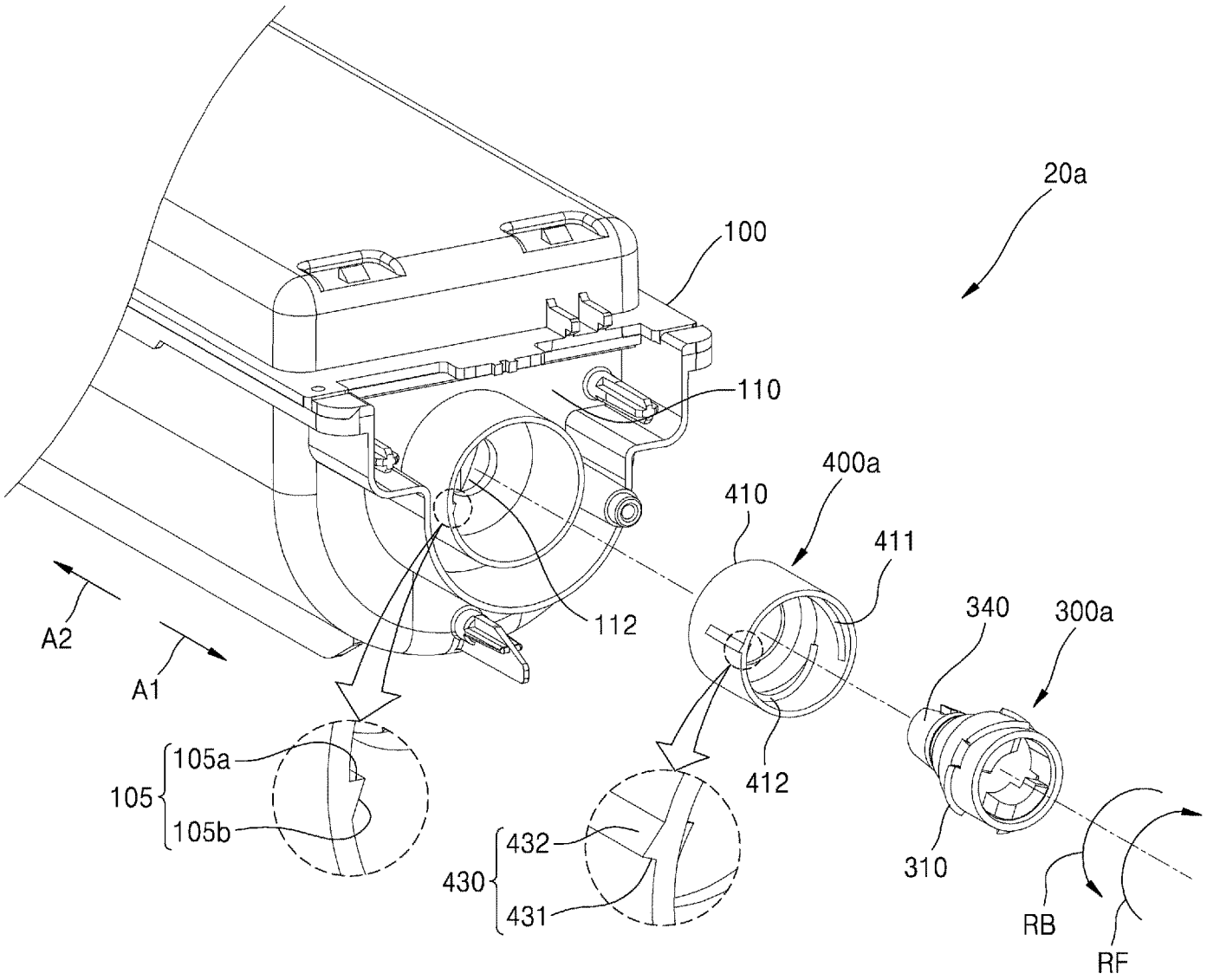
FIG. 9 is a partially exploded perspective view of a toner cartridge according to an example.
Figure 10:
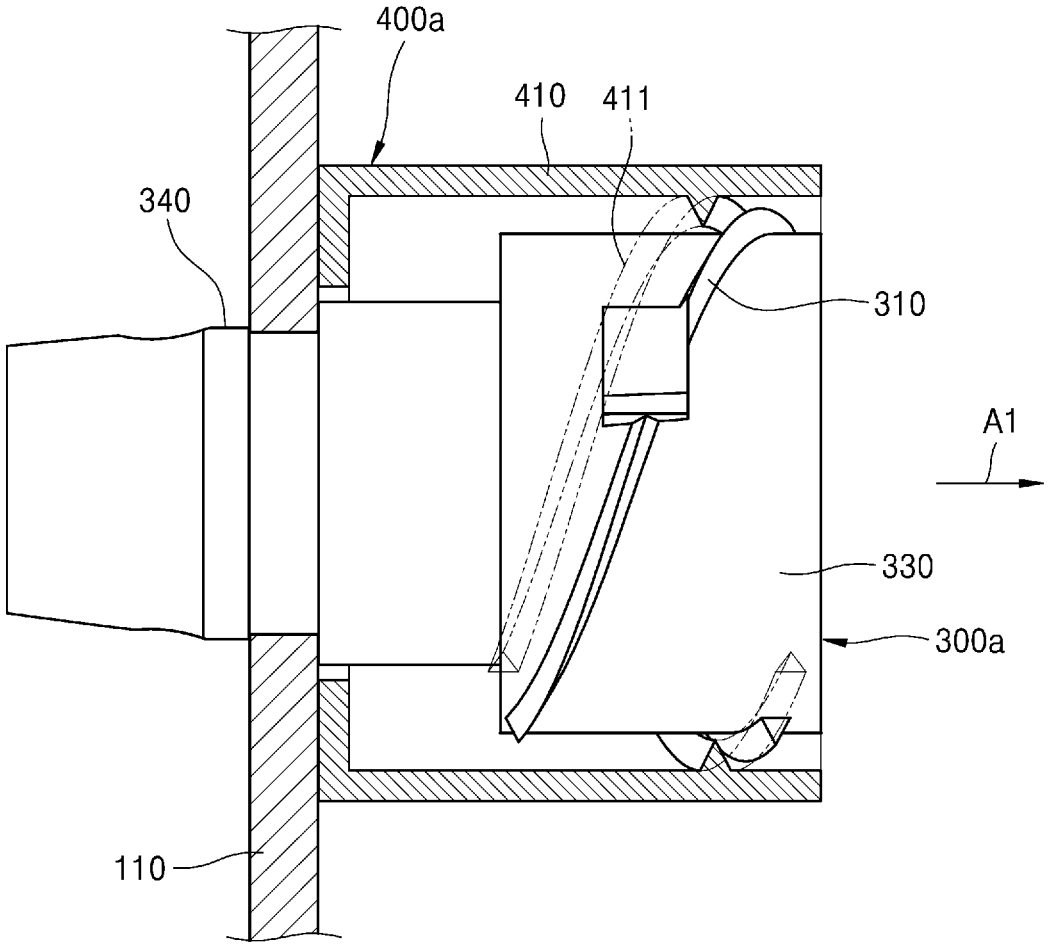
FIG. 10 illustrates a connection relationship between a driven coupler and an ejector when a driven coupler rotates in a forward direction in the toner cartridge shown in FIG. 9 according to an example.
Figure 11:
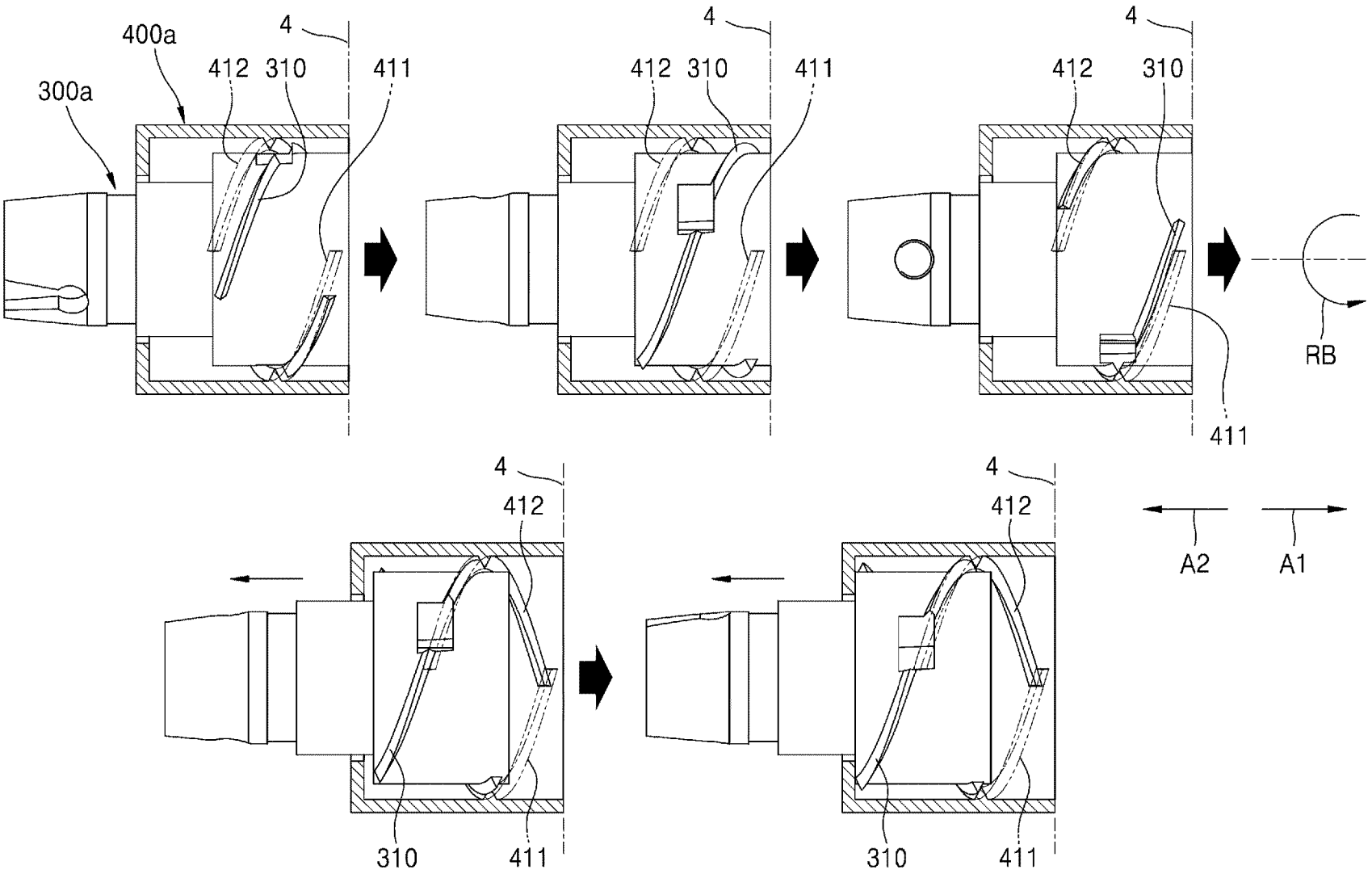
FIG. 11 illustrates a connection relationship between a driven coupler and an ejector when the driven coupler rotates in a reverse direction in the toner cartridge shown in FIG. 9 according to an example.

FIG. 9 is a partially exploded perspective view of a toner cartridge according to an example. FIG. 10 illustrates a connection relationship between a driven coupler and an ejector when the driven coupler rotates in a forward direction in the toner cartridge shown in FIG. 9 according to an example. FIG. 11 illustrates a connection relationship between a driven coupler and an ejector when the driven coupler rotates in a reverse direction in the toner cartridge shown in FIG. 9 according to an example.

Referring to FIG. 9, a toner cartridge 20*a* differs from the example of the toner cartridge 20 shown in FIGS. 4 to 8 in that the driven coupler 300*a* is rotatably supported by the side wall 110 of the housing 100 and connected to the conveying member 200 to rotate the conveying member 200, and, when the driven coupler 300*a* rotates in the reverse direction RB, the ejector 400*a* moves in a direction away from the side wall 110 with respect to the driven coupler 300*a*, that is, the mounting direction A1. Hereinafter, differences between the toner cartridge 20*a* and the toner cartridge 20 will be mainly described. Among components of the toner cartridge 20*a*, a component that performs the same function as that of the component of the toner cartridge 20 uses the same reference numeral as that of the component of the toner cartridge 20.

The ejector 400*a* is rotatably supported by the driven coupler 300*a*. The ejector 400*a* includes the inner diameter portion 410. The driven coupler 300*a* includes an outer circumferential portion 330 and a connection portion 340. The connection portion 340 passes through the inner diameter portion 410 and the mounting hole 112 provided in the side wall 110 and is inserted into the housing 100. As described above, the driven coupler 300*a* is rotatably supported by the side wall 110. The connection portion 340 may be the same as or similar to the connection portion 420 illustrated in FIGS. 4 to 8. The connection structure of the connection portion 340 and the conveying member 200 is the same or similar to as the connection structure of the connection portion 420 and the conveying member 200 described in the toner cartridge 20 above.

A gap exists between the outer circumferential portion 330 of the driven coupler 300*a* and the inner diameter portion 410, and the ejector 400*a* may move in a radial direction with respect to the driven coupler 300*a*. In addition, the ejector 400*a* is movably supported by the driven coupler 300*a* in the mounting direction A1 and the removal direction A2.

The toner cartridge 20*a* includes a rotation limiting member that allows rotation of the ejector 400*a* in the forward direction RF and does not allow rotation of the ejector 400*a* in the reverse direction RB. The rotation limiting member may be implemented by, for example, the first stopper 430 including the first opposing surface 431 and the first inclination surface 432, and the second stopper 105 including the second opposing surface 105*a* and the second inclination surface 105*b*.

The ejector 400*a* rotates in the forward direction RF by the driven coupler 300*a*. When the driven coupler 300*a* rotates in the reverse direction RF, the ejector 400*a* moves away from the side wall 110, that is, in the mounting direction A1. To this end, the driving transmission portion 310 is provided on the outer circumferential portion 330 of the driven coupler 300*a*. The first driving receiving portion 411 and the second driving receiving portion 412 are provided in the inner diameter portion 410 of the ejector 400*a*.

The first driving receiving portion 411 is engaged with the driving transmission portion 310 such that the ejector 400*a* may rotate in the forward direction RF when the driven coupler 300 rotates in the forward direction RF. In an example, the driving transmission portion 310 may protrude from the outer circumferential portion 330 of the driven coupler 300 and have a spiral shape wound in the forward direction RF. The first driving receiving portion 411 may protrude inwardly from the inner diameter portion 410 and have a spiral shape wound in the forward direction RF. When the driven coupler 300*a* rotates in the forward direction RF, as shown in FIG. 10, the driving transmission portion 310 is located opposite to the side wall 110 with respect to the first driving receiving portion 411, that is, the mounting direction A1. By such a configuration, when the driven coupler 300 rotates in the forward direction RF, the driving transmission portion 310 and the first driving receiving portion 411 are engaged with each other, and the ejector 400 rotates together with the driven coupler 300 in the forward direction RF.

The second driving receiving portion 412 is in a spiral shape that may engage with the driving transmission portion 310 such that the ejector 400*a* moves in a direction spaced apart from the side wall 110 when the driven coupler 300*a* rotates in the reverse direction RB. In an example, the second driving receiving portion 412 may have a spiral shape wound in the forward direction RF having a rotational phase difference from the first driving receiving portion 411. For example, the phase difference of the second driving receiving portion 412 with respect to the first driving receiving portion 411 may be about 180 degrees. When the driven coupler 300*a* rotates in the reverse direction RB, the driving transmission portion 310 is positioned on the removal direction A1 with respect to the second driving receiving portion 412.

When the driven coupler 300*a* rotates in the reverse direction RB, the ejector 400*a* may also rotate in the reverse direction RB. In that case, when the first opposing surface 431 is in contact with the second opposing surface 105*a*, the rotation of the ejector 400*a* stops and only the driven coupler 300*a* rotates in the reverse direction RB. As shown in FIG. 11, when only the driven coupler 300 continues to rotate in the reverse direction RB, the driving transmission portion 310 gradually moves in the removal direction A2 of the second driving receiving portion 412, and is engaged with the second driving receiving portion 412. Because the rotation of the ejector 400*a* in the reverse direction RB is not allowed, a force in a direction in which the driving transmission portion 310 and the second driving receiving portion 412 are away from each other is applied therebetween. Because the driven coupler 300*a* is supported by the side wall 110, the driven coupler 300*a* may not move in a direction spaced apart from the ejector 400*a*. Thus, the ejector 400*a* moves in the direction away from the side wall 110, that is, in the mounting direction A1.

The ejector 400*a* is in contact with the blocking wall 4 provided inside the main body 1 in a state where the toner cartridge 20*a* is mounted in the main body 1. Therefore, the ejector 400*a* may not move in the mounting direction A1. Instead, as the driven coupler 300*a* rotates in the reverse direction RB by a driving motor, the driven coupler 300*a* moves together with the housing 100 in the removal direction A2. When the rotation of the driving motor stops, the toner cartridge 20*a* stops at a position where the portion 21 in the removal direction A2 partially protrudes from the main body 1 as shown in FIG. 2. The user may hold the protruding portion 21 in the removal direction A2 and pull the toner cartridge 20*a* from the main body 1 by pulling the toner cartridge 20*a* in the removal direction A2.

It is to be understood that examples described herein should be considered in a descriptive sense only and not for purposes of limitation. Descriptions of features or aspects within each example should typically be considered as available for other similar features or aspects in other examples. While one or more examples have been described with reference to the figures, it will be understood by those of ordinary skill in the art that various changes in form and details may be made therein without departing from the spirit and scope as defined by the following claims.

What is claimed is:

1. A toner cartridge comprising:

a housing to accommodate a toner and comprising a toner discharge port at one side in a longitudinal direction;

a conveying member installed inside the housing to rotate to convey the toner toward the toner discharge port;

a driven coupler to rotate by a rotational force; and an ejector to rotate by the driven coupler, wherein either one of the driven coupler and the ejector is rotatably supported by a side wall of the housing in the longitudinal direction and connected to the conveying member to rotate the conveying member, and wherein the other one of the driven coupler and the ejector moves in a direction spaced apart from the side wall of the housing with respect to either one of the driven coupler and the ejector when the driven coupler rotates in a reverse direction which is an opposite direction to a forward direction in which the toner is conveyed toward the toner discharge port.

2. The toner cartridge of claim 1, wherein the ejector is rotatably supported by the side wall of the housing and connected to the conveying member to rotate the conveying member, and wherein the driven coupler is inserted into an inner diameter portion of the ejector.

3. The toner cartridge of claim 2, further comprising:

a rotation limiting member to allow a rotation of the ejector in the forward direction and to prevent a rotation of the ejector in the reverse direction;

a driving transmission portion provided at an outer circumference of the driven coupler;

a first driving receiving portion provided in the inner diameter portion of the ejector and to engage with the driving transmission portion such that the ejector rotates in the forward direction when the driven coupler rotates in the forward direction; and a second driving receiving portion of a spiral shape provided in the inner diameter portion of the ejector and to engage with the driving transmission portion such that the driven coupler moves in the direction spaced apart from the side wall of the housing when the driven coupler rotates in the reverse direction.

4. The toner cartridge of claim 3, wherein each of the driving transmission portion, the first driving receiving portion, and the second driving receiving portion has a spiral shape.

5. The toner cartridge of claim 3, wherein the rotation limiting member comprises a first stopper provided at an outer circumference of the ejector, and a second stopper provided in the housing such that the first stopper engages with the second stopper when the ejector rotates in the reverse direction.

6. The toner cartridge of claim 5, further comprising a regulating member to regulate a moving distance of the driven coupler in a direction spaced apart from the side wall of the housing.

7. The toner cartridge of claim 6, wherein the driven coupler comprises a regulating plate and a through hole formed through the regulating plate, and wherein the regulating member comprises a fixing portion fixed to the ejector, an extension portion extending from the fixing portion in the longitudinal direction and inserted into the through hole, and a regulating portion provided at an opposite end of the fixing portion to engage with the regulating plate.

8. The toner cartridge of claim 1, wherein the driven coupler is rotatably supported by the side wall of the housing and connected to the conveying member to rotate the conveying member, and is inserted into an inner diameter portion of the ejector.

9. The toner cartridge of claim 8, further comprising:

a rotation limiting member to allow a rotation of the ejector in the forward direction and to prevent a rotation of the ejector in the reverse direction;

a driving transmission portion provided at an outer circumference of the driven coupler;

a first driving receiving portion provided in the inner diameter portion of the ejector to engage with the driving transmission portion such that the ejector rotates in the forward direction when the driven coupler rotates in the forward direction; and a second driving receiving portion of a spiral shape provided in the inner diameter portion of the ejector to engage with the driving transmission portion such that the ejector moves in the direction spaced apart from the side wall of the housing when the driven coupler rotates in the reverse direction.

10. The toner cartridge of claim 9, wherein each of the driving transmission portion, the first driving receiving portion, and the second driving receiving portion has a spiral shape.

11. An image forming apparatus comprising:

a main body comprising a driving coupler; and a toner cartridge that is attachable to/detachable from the main body, wherein the toner cartridge comprises:

a housing to accommodate a toner and comprising a toner discharge port at one side in a longitudinal direction;

a conveying member installed inside the housing to rotate to convey the toner toward the toner discharge port;

a driven coupler connected to the driving coupler to rotate in a forward direction in which the toner is conveyed toward the toner discharge port and in a reverse direction which is an opposite direction to the forward direction;

an ejector supported by a side wall of the housing in the longitudinal direction to rotate by the driven coupler, connected to the conveying member, and comprising an inner diameter portion into which the driven coupler is inserted;

a rotation limiting member to allow a rotation of the ejector in the forward direction and to prevent a rotation of the ejector in the reverse direction;

a driving transmission portion provided at an outer circumference of the driven coupler;

a first driving receiving portion provided in the inner diameter portion of the ejector to engage with the driving transmission portion such that the ejector rotates in the forward direction when the driven coupler rotates in the forward direction; and a second driving receiving portion of a spiral shape provided in the inner diameter portion of the ejector to engage with the driving transmission portion such that the driven coupler moves in a direction spaced apart from the side wall of the housing when the driven coupler rotates in the reverse direction.

12. The image forming apparatus of claim 11, wherein each of the driving transmission portion, the first driving receiving portion, and the second driving receiving portion has a spiral shape.

13. The image forming apparatus of claim 11, wherein the rotation limiting member comprises a first stopper provided at an outer circumference of the ejector, and a second stopper provided in the housing such that the first stopper engages with the second stopper when the ejector rotates in the reverse direction.

14. The image forming apparatus of claim 11, further comprising a regulating member to regulate a moving distance of the driven coupler in a direction spaced apart from the side wall of the housing.

15. The image forming apparatus of claim 14, wherein the driven coupler comprises a regulating plate and a through hole formed through the regulating plate, and wherein the regulating member comprises one end portion fixed to the ejector, an extension portion extending from the one end portion in the longitudinal direction and inserted into the through hole, and a regulating portion provided at another end portion of the extension portion to engage with the regulating plate.

* * * * *